United States Patent [19]

van der Heyden

[11] Patent Number: 4,483,563

[45] Date of Patent: Nov. 20, 1984

[54] DEVICE FOR HANDLING AN OBJECT SUCH AS A PIPE OR PILE

[75] Inventor: Henricus J. T. M. van der Heyden, Warmond, Netherlands

[73] Assignee: Heerema Engineering Service B.V., Leiden, Netherlands

[21] Appl. No.: 404,834

[22] Filed: Aug. 3, 1982

[30] Foreign Application Priority Data

Aug. 5, 1981 [NL] Netherlands ..... 8103694

[51] Int. Cl.[3] ..... B66C 1/00; E21B 23/00

[52] U.S. Cl. ..... 294/90; 285/396; 294/86.1; 294/86.17; 403/348

[58] Field of Search ..... 294/86 R, 86.1, 86.17, 294/86.2, 86.21, 90, 110 R, 110 B; 166/240; 285/360, 376, 394, 396, 401, 402; 403/348, 349, 375

[56] References Cited

U.S. PATENT DOCUMENTS

| | | | |
|---|---|---|---|
| 1,717,497 | 6/1929 | Davis | 294/86.17 |
| 2,799,344 | 7/1957 | Muse | 285/396 X |
| 3,072,430 | 1/1963 | Fahrenwald | 294/90 X |
| 3,211,479 | 10/1965 | Brown | 285/360 |
| 4,199,210 | 4/1980 | Trott | 166/240 X |
| 4,273,464 | 6/1981 | Scott | 294/86.1 X |

FOREIGN PATENT DOCUMENTS

| | | | |
|---|---|---|---|
| 936453 | 9/1963 | United Kingdom | 294/110 B |

*Primary Examiner*—Johnny D. Cherry

*Attorney, Agent, or Firm*—Silverman, Cass & Singer, Ltd.

[57] ABSTRACT

A device for handling an object such as a pipe comprising a cylindrical member, with four disposed adjacent one another elongate grooves or recesses in the peripheral direction in the surface thereof and extending in upward direction, with the first and last open at the bottom, and merging into one another at the top and bottom ends via trapezoidal grooves or recesses, the whole being adapted to receive and co-operate with at least one lug projecting from the surface of the pipe.

1 Claim, 9 Drawing Figures

DEVICE FOR HANDLING AN OBJECT SUCH AS A PIPE OR PILE

BACKGROUND OF THE INVENTION

1. Field of the Invention

This invention relates to a device for handling an object such as a pipe or pile, comprising a cylindrical member acting thereon.

2. Discussion of the Prior Art

Dutch patent application No. 7806603, laid out for public inspection describes such a device, which is particularly intended to be used when constructing offshore platforms using telescoping pipes. It comprises a cylindrical hoisting body which is to be lowered into the pipe and carries a number of sidewise extending locking elements cooperating with lugs on the inner surface of the pipe. This known structure is very complicated and costly; it is only capable of handling a limited weight and its practical use gives rise to many problems.

French Patent Specification No. 1,188,167 describes a device for lifting tubes comprising outwardly movable hooks, which fit into a corresponding ringshaped recess in the inner wall of the tube. The mechanism for actuating the hooks is based on the principle of using a cylindrical body provided with a pattern of grooves which is moved up and down to rotate it stepwise and which actuates the hooks through a cam mechanism.

Another device for lifting pipes is disclosed in U.S. Pat. No. 3,485,388; it comprises radially extensible shoes which are pressed outwardly by a conical cam in its upper position; the cam movement is controlled by means of radially extending lugs cooperating with a pattern of grooves in a cylindrical actuating mechanism which is moved up and down.

Devices comprising lugs cooperating with a pattern of grooves such as the one used in the device according to the present invention and used for actuating gripper mechanisms are known in various embodiments; examples are disclosed in the U.S. Pat. No. 1,506,827, GB Patent Specification No. 629,367, French Patent Specification No. 985,576 and U.S. Pat. No. 2,818,443.

SUMMARY OF THE INVENTION

The invention aims to provide a very simple device of the abovementioned kind which is very reliable, simple to use and which does not need any special auxiliary equipment, such as hydraulic equipment.

According to the invention the cylindrical member comprises four elongate grooves or recesses disposed adjacent one another in the peripheral direction in the surface of said member, said grooves or recesses extending in the upward direction and the first and last being open at the bottom and merging into one another at the top and bottom ends respectively via trapezoidal grooves or recesses leading by the small long side into the preceding groove or recess, the said trapezoidal grooves or recesses being adapted to receive at least one lug projecting from the surface of the pipe or pile and cooperating with the transverse walls of the grooves or recesses.

When the cylindrical body is moved up and down over a distance corresponding to the length of the grooves or recesses the interaction between the lug and the transverse walls of the grooves or recesses will bring about a rotation of the body during each up and down movement over an angle corresponding with the distance between the axis of the grooves so that after a downwardly movement, followed by an upward movement, the transverse wall of the third groove or recess will bear against the lug and take it with it when the cylindrical body is moved upwardly; in this situation the pipe or pile can be hoisted and handled. When the end of the pipe or pile rests upon the bottom or on another support, a further downward movement of the cylindrical body will free the lug from the third groove so that the body again rotates over an angle corresponding with the distance between the third and fourth groove; when then the cylindrical body is hoisted it will be free from the lug and can be removed.

To distribute the forces exerted on the pipe or pile evenly over its circumference the device is preferably provided with a plurality of elongate grooves or recesses each cooperating with a lug, the last of each of the said grooves or recesses leading into a narrow portion of a trapezoidal groove or recess of which the wide part forms the bottom end of the first entry groove or recess of the adjacent set.

In a device to be used for handling pipes the grooves or recesses will be present at the outer surface of a cylindrical body to be lowered into the pipe and cooperating with a lug which radially extends from the wall of this pipe inwardly.

Preferably the device comprises two sets of grooves or recesses for co-operation with two diametrically opposite lug elements and a radially extending rocker or the like supported in the centre and disposed inside the cylindrical element, the ends of said rocker projecting into the lowest portion of the second trapezoidal recess.

Thus it is not necessary that the lugs are exactly diametrically opposite each other to ensure that the lifting force is exerted on both of them: the rocking arm will adjust itself in such a way that the ends thereof bear on the two lifting lugs.

An embodiment suitable for handling piles or pipes which are closed at their upper end is such that the grooves or recesses are situated on the inner surface of a tube adapted to be placed over the pile for handling and co-operate with a lug projecting radially outwards from the outer wall of said tube.

It is clear that the grooves or recesses can be obtained by recess parts in the mantle surface but also by providing suitable profiled guide plates or guide rods.

DESCRIPTION OF THE DRAWINGS

FIGS. 3*a* and 3*b* are side elevations of a second embodiment of the invention.

DESCRIPTION OF PREFERRED EMBODIMENTS

Figure 1A:
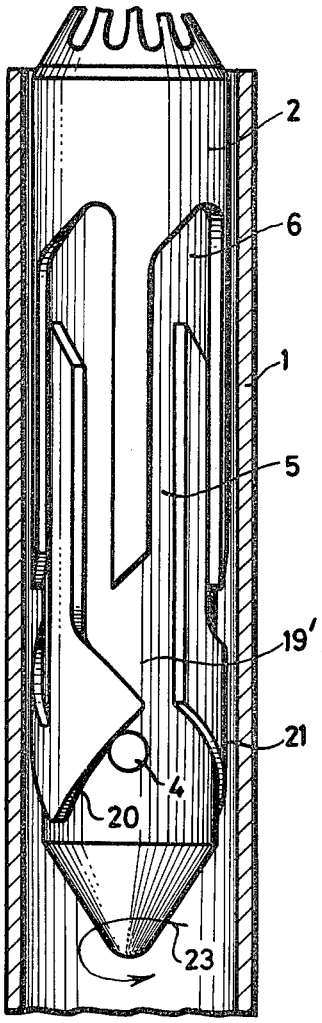
FIGS. 1*a* to 1*e* show the various phases of movement of a first embodiment of the invention.
Figure 1B:
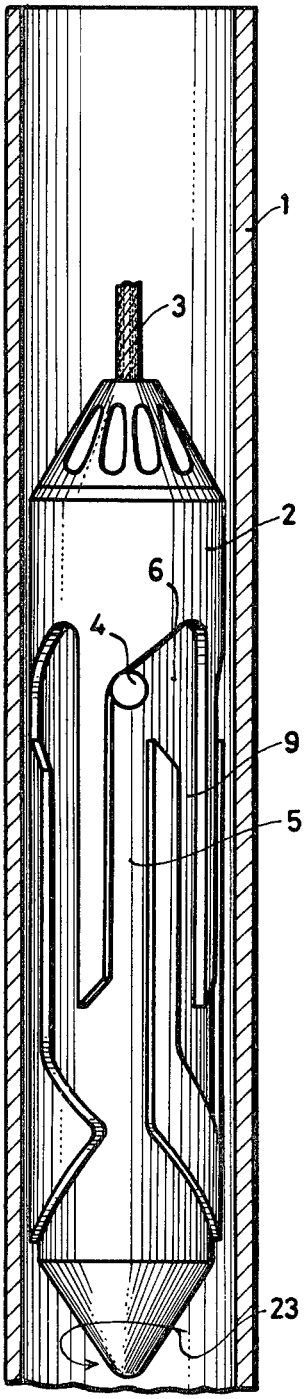
Figure 1C:
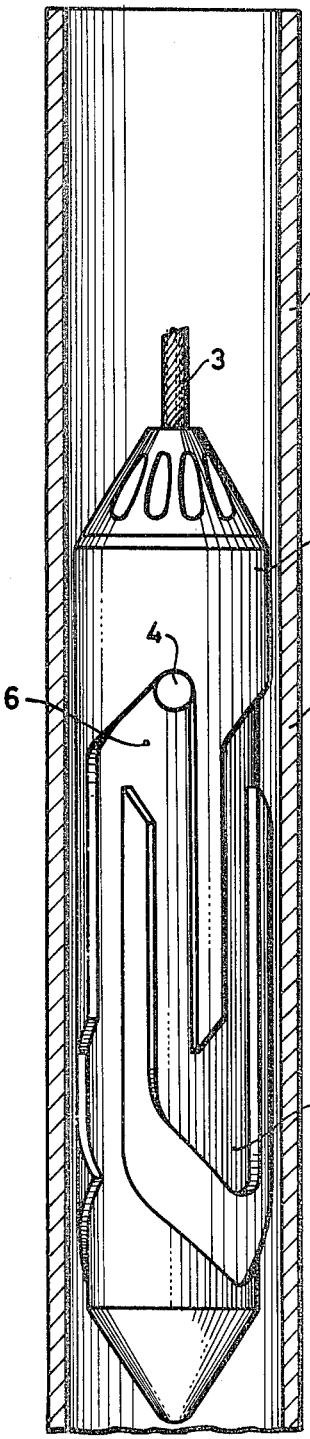

FIG. 1 shows part of a pipe, indicated by reference numeral 1, with the cylindrical lifting member therein, denoted generally by reference numeral 2. It is suspended in a manner not shown in detail from a cable 3 connected to a lifting device, which is not shown either.

To enable the pipe 1 to be handled with the lifting member 2, two diametrically opposite lugs 4 are provided on the inner wall of the pipe. The way in which this is done is immaterial to the invention and is thus not shown in detail. The lugs may, for example, be welded directly to the pipe or be fitted to a support plate fixed to the inner wall of the pipe.

The outer surface of the lifting member 2 is provided with a pattern of specially shaped grooves or recesses, the upright edges of which co-operate with the lugs 4. In the case illustrated, there are two sets of grooves, shown in developed form in FIG. 2. This Figure also shows the path of the grooves or recesses around the lugs 4 although for the sake of clarity the various positions of the lug 4 with respect to the grooves are shown with the situation illustrated as if the grooves were stationary and the lug moving therethrough.

Each set of grooves or recesses is made up of the following (see FIG. 2):

An entry groove 5 terminating at the top into a substantially trapezoidal recess 6, the short side 7 of which is situated at the top end of the groove 5. The long side 8 of this recess forms the top end of the first intermediate groove 9, the bottom end of which terminates in the short side 10 of a second trapezoidal recess 11. The long side 12 thereof is also the bottom end of the second intermediate groove 13 of the latter, the top end merges into the short side 14 of the third trapezoidal recess 15, the long side 16 of which forms the top end of the exit groove 17. At the bottom the groove 17 terminates in the short side 18 of the trapezoidal recess 19, which is also the start of the next entry groove of the next set of grooves.

Beneath the grooves is a recessed space the depth of which radially is equivalent to the depth of the abovedescribed recesses; this space is defined by the oblique guide edges 20, 21 and 22. The device operates as follows:

When the cylindrical member is lowered into the pipe—the situation shown in FIG. 1*a*—the lug 4 will abut against one of the edges 20 or 21. It is assumed that this is the edge 20; the cylindrical member will then rotate clockwise from the position shown in FIG. 1*a* in the direction of arrow 23 so that the bottom end of the groove 5 formed by the trapezoidal recess 19' will be situated opposite the lug 4. This position is indicated by 4*a*. Further descent of the cylindrical member 2 results in the situation shown in FIG. 1*b*; the movement of the lug 4 with respect to the member 2 is as shown by the short arrows; in fact, the lug 4 is stationary and the member 2 moves therealong. The top edge of the recess 6 moves along the lug 4 so that the member again turns through a small angle in the direction of arrow 23 until the right top corner of the recess 6 abuts the lug 4. The position of the lug is shown by reference 4*b* in FIG. 2.

During these operations, no lifting force is exerted on the pipe itself, so that its position remains unchanged.

Figure 1D:
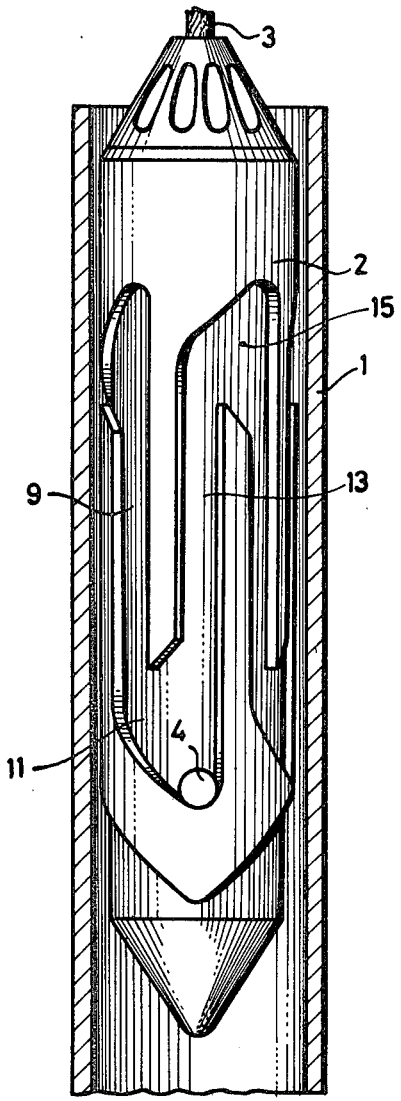
Figure 2:
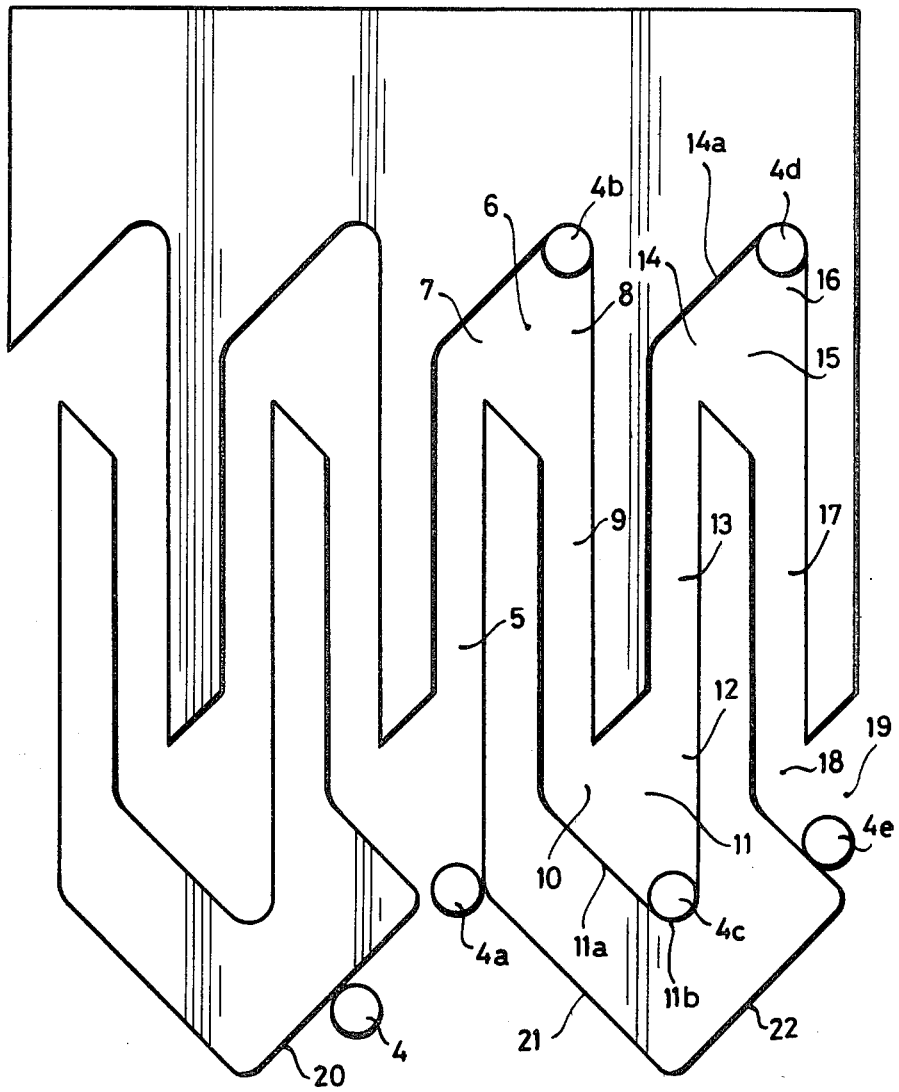
FIG. 2 is a developed view of the pattern of the grooves or recesses and shows the action of the device according to the invention.
Figure 5A:
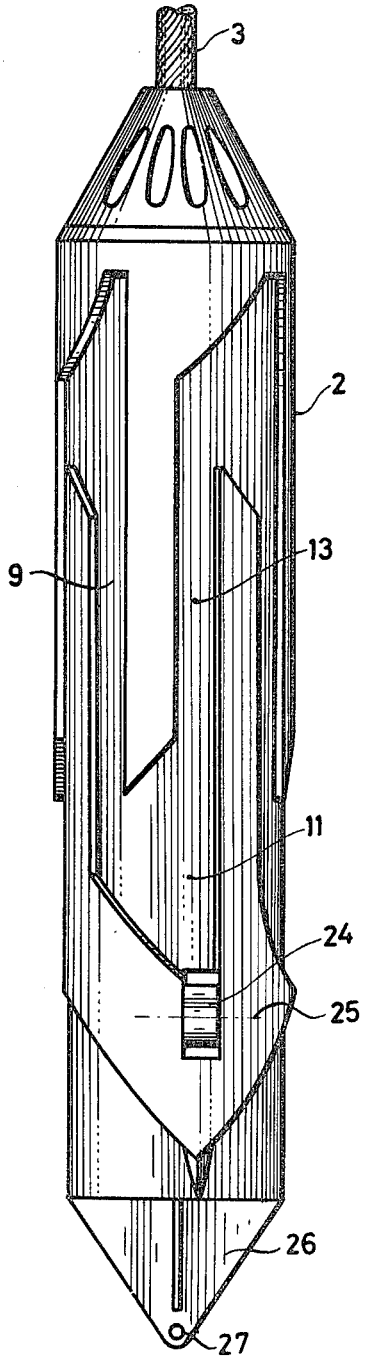
Figure 5B:
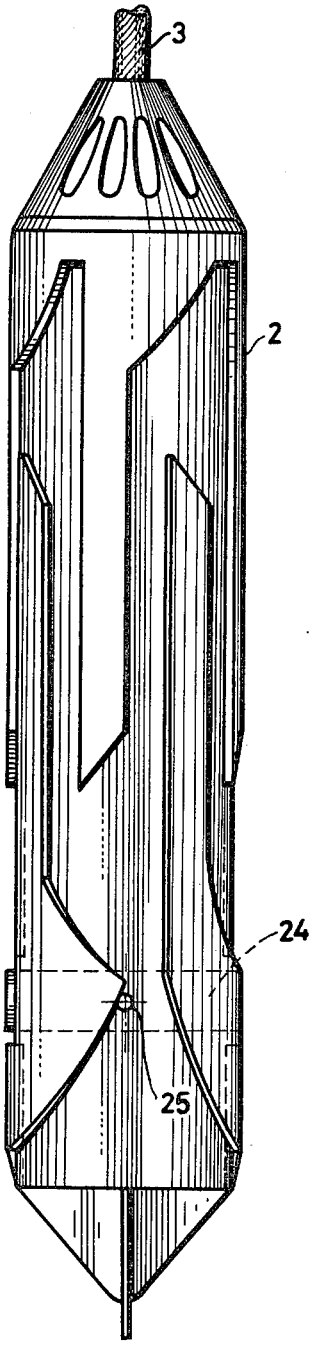

If the lifting member 2 is now raised, lug 4*a* moves through groove 9 and comes, via the obliquely downwardly extending edge 11*a* of the recess 11, into the bottom boundary 11*b* thereof. The position of the lug with respect to the lifting member is then as shown in FIG. 2 by reference 4*c*; this situation is also illustrated in FIG. 1*d*. When the member 2 is lifted via cable 3, the pipe will be taken along because the bottom boundary of the recess 11 takes the lug 4 with it.

Figure 1E:
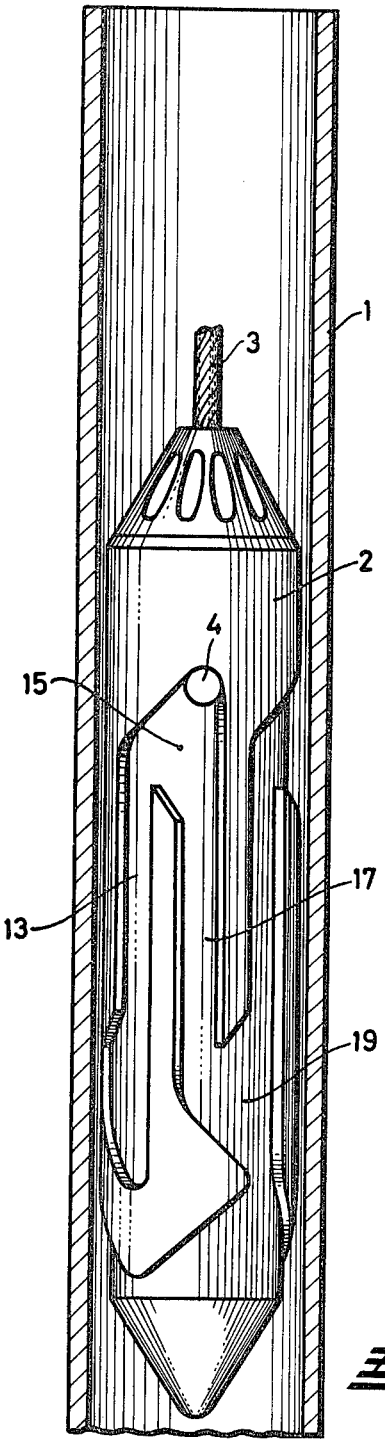

When the pipe is in the correct position, the lifting member can be removed from the pipe very simple; when the cable 3 is paid out, the cylindrical member 2 will move down by its own weight so that the lug 4 passes via groove 13 and the obliquely sloping edge 14*a* of recess 14, into the position shown by reference 4*d* in FIG. 2. This situation is also shown in FIG. 1*e*. During the transition from the groove 13 to the right-hand top corner of the recess 15 the lifting member has again turned clockwise through a small angle. All that is required now is to lift the member 2 to release it from the lugs 4. The lug moves through the exit groove 17 and is freed, via the recess 19, from the member 2, which can be withdrawn from the pipe unobstructed.

Operation with the lifting member according to the invention is therefore equivalent to the performance of a number of alternate lifting and lowering movements; during one of the lifting movements the member entrains the pipe, which remains in position around the member. After the pipe has been put down a lowering movement followed by a lifting movement is sufficient to release the lifting member from the pipe.

FIGS. 3*a* and 3*b* show a somewhat modified embodiment suitable for use in a pipe with two diametrically opposite lugs which are not at exactly the same height. In this Figure, like parts have been given like references.

The embodiment shown in FIGS. 3*a* and 3*b* differs from that shown in FIGS. 1 and 2 in that the bottom boundary of the recess 11 against which the lug 4 bears during lifting is not formed by the edge itself but by the ends of a rocker 24 which is supported to be pivotable about the axis 25 half way along the length of the rocker 24 in the member 2. Thus even when the lugs 4 are not exactly diametrically opposite one another engagement will nevertheless take place on both lugs during the lifting operation.

This embodiment also includes a support 26 with an eyelet 27 by means of which the lifting member can be weighted with an extra weight.

Figure 4:
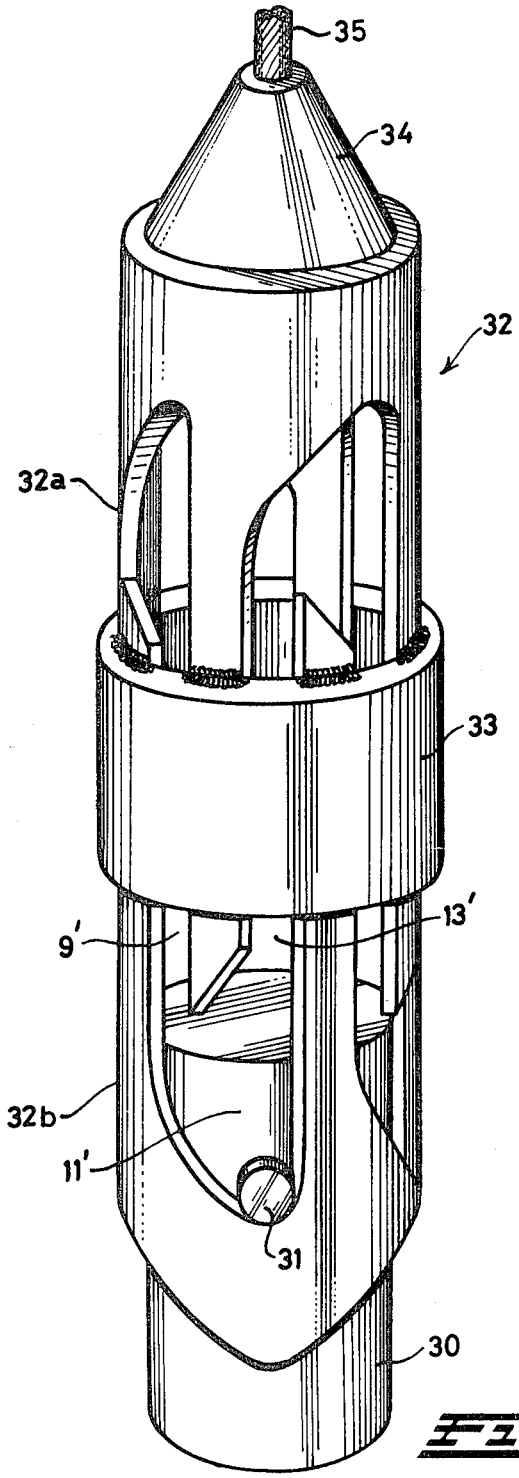
FIG. 4 is a perspective view of one embodiment of the invention suitable for use with a solid pile.

FIG. 4 shows an embodiment suitable for handling solid piles. A pile of this kind is shown by reference 30. Two diametrically opposite lugs 31 are provided on the pile and extend radially out from the surface of the pile. The grooves are disposed here in the cylinder 32, which is actually divided into two parts 32*a*, 32*b* by the pattern of grooves and recesses, said parts being held together by the welded-on sleeve 33. At the top end the cylinder bears the lifting head 34 connected to the cable 35.

The grooves and recesses are the same as those formed in the surface of the cylinder 2; they are shown in FIG. 4 by the same references followed by the apostrophe.

The operation of the lifting device shown in FIG. 4 is the same as that described hereinbefore and will not therefore be explained in greater detail.

The device according to the invention is extremely simple while its operation is completely safe: The lifting of a pipe or pile is possible only if the lifting device occupies with respect to the lugs mounted on the pipe or pile for lifting the position shown in FIG. 1*d* and FIG. 4 and in this position the lugs can never work free from the lifting device. It is therefore impossible for the load to become detached from the lifting device during the lifting operation.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A device for handling an object such as a pipe or pile of the type which includes a pair of two diametrically opposite lugs projecting radially inwardly from the surface of the pipe or pile; said handling device comprising, a cylindrical member acting on said object, said cylindrical member having two sets of four elongate grooves or recesses formed in the outer surface thereof disposed adjacent one another in the peripheral direction, trapezoidal grooves or recesses formed in said outer surface at the top and bottom ends of said elongate grooves or recesses, said elongate grooves or recesses extending in the upward direction and the first and fourth of each set being open at the bottom and merging into one another via said trapezoidal grooves or recesses of which the shortest of the parallel sides thereof terminates into the preceding groove or recess and a radially extending rocker supported in the center and disposed interior of the cylindrical member, said rocker having ends projecting into the lowest portion of the trapezoidal groove or recess present between the second and third groove of said two diametrically opposed sets of grooves or recesses, said cylindrical member capable of being lowered into the pipe for handling and being cooperative with said radially inwardly extending lug.

* * * * *